US006145980A

United States Patent [19]

Wang

[11] Patent Number: 6,145,980

[45] Date of Patent: Nov. 14, 2000

[54] MULTIPLE-ZONE INKJET PRINTER

[75] Inventor: Shih-Yuan Wang, Palo Alto, Calif.

[73] Assignee: Hewlett-Packard Company, Palo Alto, Calif.

[21] Appl. No.: 09/199,986

[22] Filed: Nov. 24, 1998

[51] Int. Cl.[7] ..... B41J 2/01

[52] U.S. Cl. ..... 347/104; 347/37; 400/23; 400/48

[58] Field of Search ..... 347/37, 104, 108, 347/19, 9, 87; 400/23, 29, 31, 34, 44, 45, 46, 47, 48, 279; 101/483

[56] References Cited

U.S. PATENT DOCUMENTS

| | | | |
|---|---|---|---|
| 3,583,540 | 6/1971 | Bernard | 400/29 |
| 4,461,587 | 7/1984 | Schöttle | 400/48 |
| 4,734,717 | 3/1988 | Rayfield | 400/175 |
| 5,490,734 | 2/1996 | Maruyama et al. | 400/279 |
| 5,739,828 | 4/1998 | Moriyama et al. | 347/9 |
| 5,742,305 | 4/1998 | Hackleman | 347/42 |
| 5,984,464 | 11/1999 | Steinfield et al. | 347/87 |
| 6,019,466 | 2/2000 | Hermanson | 347/104 |
| 6,076,915 | 6/2000 | Gast et al. | 347/19 |
| 6,079,888 | 6/2000 | Chen et al. | 347/104 |
| 6,082,854 | 7/2000 | Axtell et al. | 347/108 |

*Primary Examiner*—Eugene Eickholt

[57] ABSTRACT

An inkjet printer includes a ball roller assembly for driving a paper-supporting platen along the width and length of the paper supported by the platen. A stepper motor activates the ball roller assemblies in response to drive signals from a motor driver. A first printhead includes a first array of inkjet nozzles which are in fluid communication with an ink supply and which fire in response to drive signals from a printhead driver. A microprocessor is provided to coordinate x and y axis movement of the paper with the firing of the first array of inkjet nozzles to print a predetermined pattern. In one embodiment, the ink supply includes a second print-mode ink supply in fluid communication with a second array of inkjet nozzles on the first printhead and a first print-mode ink supply in fluid communication with the first array of nozzles. In another embodiment, the printer further includes a second printhead, which includes a third array of inkjet nozzles in fluid communication with the first print-mode ink supply and a fourth array of inkjet nozzles in fluid communication with the second print-mode ink supply. The microprocessor activates the first and third arrays during a first operational mode and activates the second and fourth arrays during a second operational mode. The microprocessor can simultaneously enable the first and second operational modes according to requirements of a print job.

20 Claims, 6 Drawing Sheets

MULTIPLE-ZONE INKJET PRINTER

TECHNICAL FIELD

The invention relates generally to inkjet printers and, more specifically, the invention relates to multiple-zone inkjet printers.

BACKGROUND ART

Inkjet printers provide an inexpensive means for printing documents from a personal computer. A conventional inkjet printer includes a movable inkjet printhead mounted on a carriage assembly. The carriage assembly moves the inkjet printhead over a print medium, such as paper. The printhead has an ink supply and an array of nozzles which generate ink droplets as the printhead moves over the paper to produce a desired image on the paper. Each nozzle is formed by a nozzle chamber, a firing mechanism, and an orifice, with the firing mechanism being located within the nozzle chamber. During operation, the nozzle chamber receives ink from the ink supply and the firing mechanism is activated, thereby causing an ink droplet to be fired from the chamber through the orifice onto the paper. A roller moves the paper in a direction perpendicular to the motion of the printer head so that the printhead nozzles can progressively lay down segments of the desired pattern.

A trend in inkjet printer technology has been to increase the number and the density of inkjet nozzles, which can result in increased resolution of images produced by the printhead. The increased number of nozzles can also decrease the distance which the printhead is required to travel, if additional nozzles are added laterally in the direction of travel of the printhead. The printhead has less distance to travel, because the nozzles of the printhead are located closer to the opposed margins of the paper as the printhead begins to traverse the paper. U.S. Pat. No. 5,742,305, which is assigned to the assignee of the present invention, describes a page-wide-array (PWA) printer element which has an array of inkjet nozzles spanning the width of a paper. While a conventional inkjet printer head has approximately 100 to 200 inkjet nozzles, the PWA printer element has between 5,000 and 7,000 inkjet nozzles. Consequently, the PWA printer element is able to remain stationary while it prints an entire line across a page.

Although the PWA inkjet printer is able to increase print speed significantly by printing an entire line at once or multiple lines simultaneously, the complexity introduced by the increased number of inkjet nozzles is significant. For an eleven-inch (279.4 mm) printhead with 600 dots per inch (23.62 dots per millimeter), there are at least 6600 nozzles.

What is needed is an inkjet printer which provides increased print speed over conventional scanning printhead inkjet printers and which enables simultaneously printing in multiple print modes.

SUMMARY OF THE INVENTION

An inkjet printer includes a first inkjet printhead having a first array of inkjet nozzles which generate multiple projections of ink droplets, a drive system for moving print media, such as paper, along two axes of motion which are perpendicular to each other and to the direction of the ink projections, and a processor for coordinating operation of the drive system with the firings of the inkjet nozzles.

In a preferred embodiment, the drive system includes a first stepper motor which drives a ball roller that contacts a paper-supporting platen to drive the platen along the first axis of motion (e.g., along the widthwise direction of the paper) and along the second axis of motion (e.g., along the lengthwise direction of the paper). The inkjet printhead includes an ink supply in fluid communication with each of the inkjet nozzles of the first array such that, upon being fired, a nozzle generates an ink droplet which is approximately perpendicular to the paper surface. The processor coordinates operation of the stepper motor with the firing of selected ones of the nozzles to print the desired pattern on the paper. The coordinating functions of the printer processor can alternatively be performed by a processor in an associated personal computer (PC).

In one implementation, the inkjet printhead includes a second array of inkjet nozzles and the ink supply includes first general purpose color printing ink reservoirs and first photographic color printing ink reservoirs. The first array of inkjet nozzles is in fluid communication with the first general purpose color printing ink reservoirs and the second array of nozzles is in fluid communication with the first photographic color printing ink reservoirs. The processor responds to a second mode activation request by activating the second array of inkjet nozzles. The processor is responsive to requirements of a particular print job to activate the first and/or second array of inkjet nozzles. For example, a print job might include a photograph which requires photographic color printing ink and a surrounding border which requires regular color printing ink. The processor will activate both the general purpose color print-mode and the photographic color print-mode so that the second array inkjet nozzles can print the photographic color print region simultaneously with first array nozzles printing the general purpose color print region of the boundary. The ink supply can also include a black ink reservoir for black and white printing in fluid communication with a corresponding third array of inkjet nozzles. The processor can activate any combination of general purpose color printing, photographic color printing, and/or black and white printing modes.

In a preferred embodiment, the printer includes a second inkjet printhead having third and fourth inkjet nozzle arrays respectively in fluid communication with second general purpose color printing ink reservoirs, and second photographic ink reservoirs. Alternatively, the first general purpose color printing ink reservoirs can provide a common supply to both the third array of the second printhead and the first array of the first printhead, while the first photographic color printing ink reservoirs provide a common supply to both the fourth array of the second printhead and the second array of the first printhead. The third and fourth nozzle arrays of the second inkjet printhead are positioned approximately coplanar to the first and second nozzle arrays. Preferably, the general purpose color printing ink reservoirs and the photographic color printing ink reservoir both include a black ink reservoir for black and white printing.

The processor assigns the first and/or second array to apply ink to a first section of the paper in order to form a first portion of a desired pattern and assigns the third and/or fourth array to print a second portion of the desired pattern on a second section of the paper. The processor coordinates the operation of the first and second inkjet printheads, such that the first printhead prints the first portion of the desired pattern simultaneously with the printing of the second portion by the second printhead. The processor executes a stitching algorithm to ensure that a boundary between the first portion of the pattern printed by the first printhead and the second portion of the pattern printed by the second printhead is as seamless as possible. Alternatively, the PC processor can be utilized to execute the stitching algorithm.

In a preferred mode, the processor defines the borders of the portions of the pattern assigned to the printheads in response to color contrasts or shading within the pattern so as to minimize the visibility of the boundaries. Furthermore, the stitching algorithm can define slightly overlapping portions of the pattern assigned to the printheads to minimize visibility of boundaries.

The processor activates print-modes in the second printhead in the same manner as for the first printhead. In an alternative embodiment, the first and second printheads each has only one array of inkjet nozzles in fluid communication with either a general purpose color printing ink supply, a black ink supply, or a photographic color printing ink supply. The ink supply in both embodiments preferably includes an ink supply sensor.

Another embodiment of the invention provides increased resolution printing through precise relative incremental motion between the printhead and the paper. The distance of each increment is no more than the diameter of a print region of a stationary inkjet nozzle. A second motor is provided to incrementally move the printhead and the processor coordinates the firing of the inkjet nozzles with the incremental movement of the inkjet nozzles to increase the printing resolution of the inkjet nozzles. By incrementally moving, the inkjet printhead can deposit a higher density of dots on the paper than is possible with a completely stationary printhead due to design constraints for inkjet nozzle density on a printhead. Alternatively, the printhead can remain stationary while the paper is incrementally moved.

A method for utilizing the inkjet printer includes projecting a first set of ink droplets from the first print-mode ink supply of the first inkjet printhead at an angle that is approximately perpendicular to the paper surface. The paper surface is moved along two axes, the length and width of the paper. The movement of the paper is coordinated with the generation of the ink droplets to print the desired pattern on the paper surface. In a preferred embodiment, the second printhead applies a third set of ink droplets within a second section of the paper surface simultaneously with application of the first ink droplets within a first section of the paper surface. The movement of the paper is coordinated with the generation of the first and third ink droplets to print the desired pattern.

The method includes a second print-mode activation step which includes generating a second set of ink droplets from the second print-mode ink supply of the first printhead. Again, the movement of the paper is coordinated with the generation of the second set of ink droplets to print a pattern on the paper without switching ink supply cartridges, since the first printhead includes both the first print-mode and the second print-mode ink supplies.

In the dual printhead embodiment, the second print-mode activating step includes projecting a fourth set of ink droplets from a second print-mode ink supply on the second printhead without removing a first print-mode ink supply on the second inkjet printhead and replacing the first print-mode ink supply with the second print-mode ink supply.

The inkjet printer of the present invention provides the advantage of high speed inkjet printing by simultaneously utilizing multiple printheads to perform print jobs. Another advantage of the present invention is that the printhead can support high volume ink reservoirs, because the printhead is not required to traverse the width of the paper. Yet another advantage is that a print-mode switch can be performed without having to substitute ink cartridges. Another advantage is that two or more print-modes can be simultaneously activated during a print job using multiple printheads.

DETAILED DESCRIPTION

Figure 1:
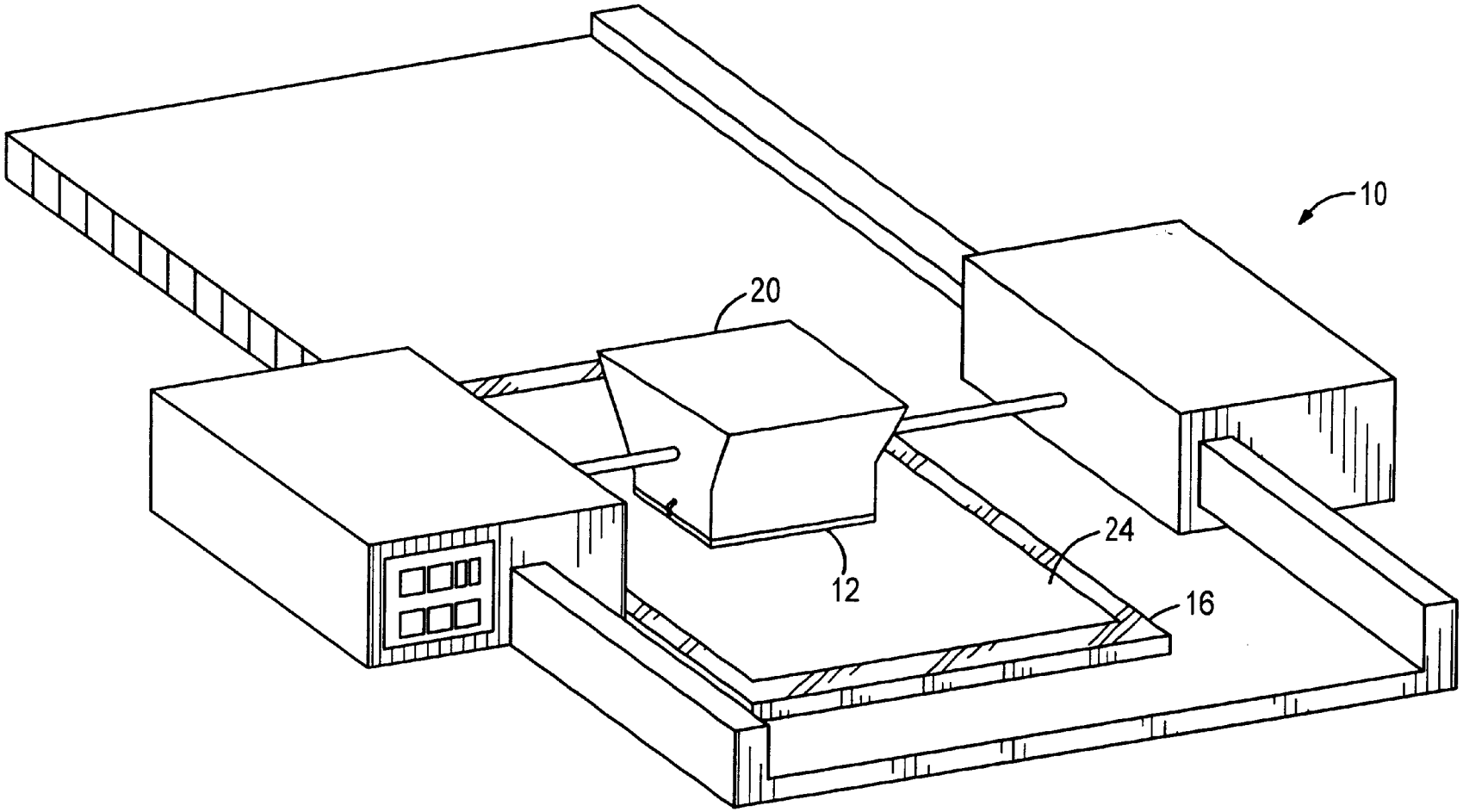
FIG. 1 is a perspective view of an inkjet printer in accordance with the present invention.

Referring to FIG. 1, an inkjet printer 10 in accordance with the present invention includes an inkjet printhead 12 that is removably attached to an ink supply 20. The ink supply can include more than one ink source. For example, the ink supply 20 can include two compartments, one which provides a general purpose color printing ink supply including black ink and another which provides a photographic color printing ink supply, also including black ink. Because the inkjet printhead 12 does not scan the width of a print medium during operation of the printer 10, the ink supply can hold large volumes of ink to enable printing for long durations without having to replace the ink supply 20. As will be discussed in greater detail below, the dual-source ink supply enables an automatic print-mode shift from a general purpose color printing print-mode to a photographic color printing print-mode without having to manually switch ink supply cartridges. The dual-source ink supply also enables simultaneous activation of two or more print-modes.

Figure 2:
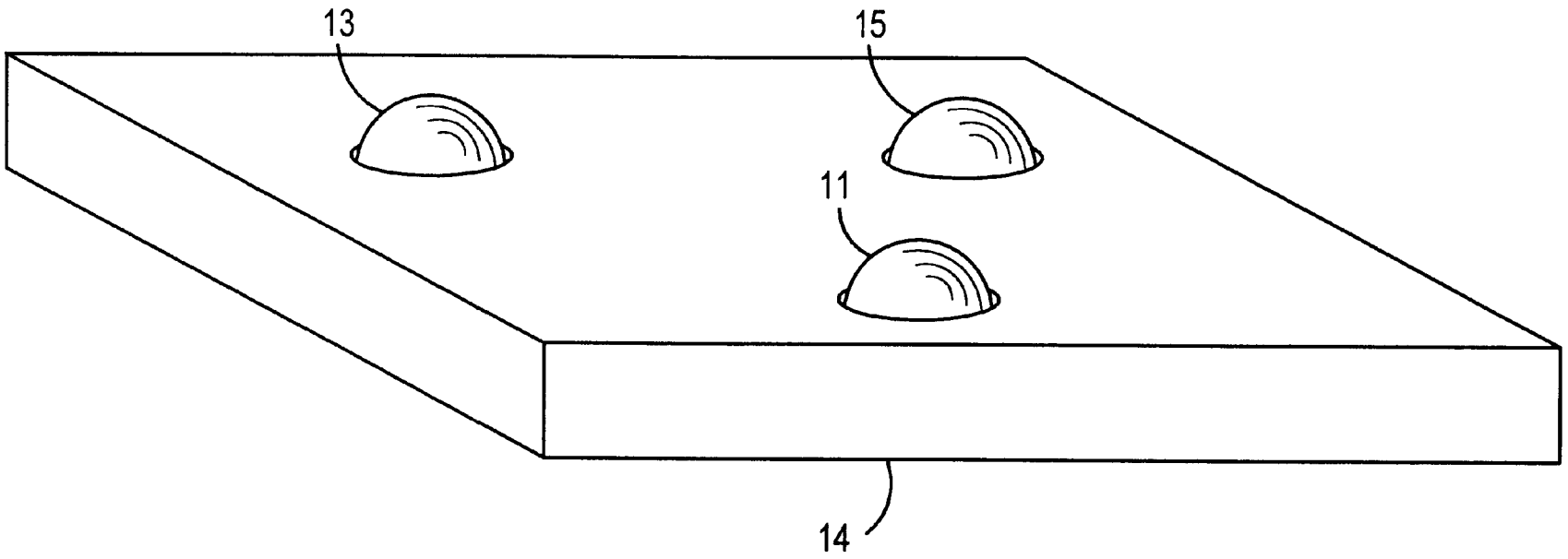
FIG. 2 is a perspective view of the ball rollers of a ball roller assembly of the printer in FIG. 1.
Figure 3:
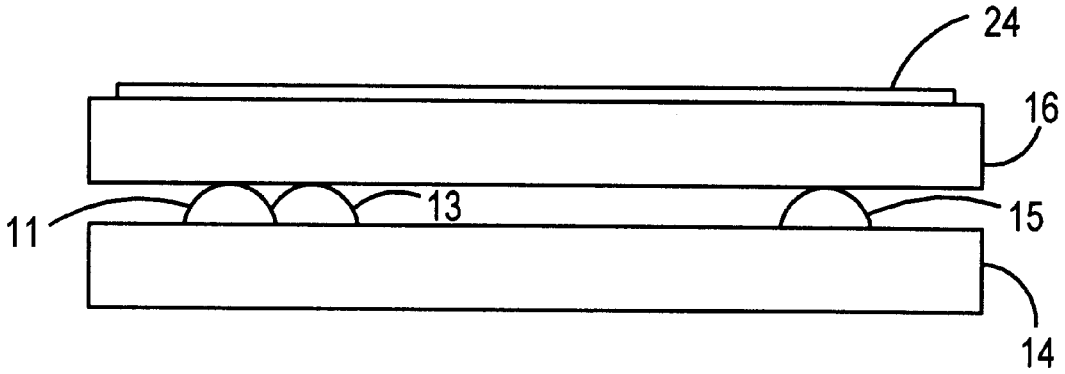
FIG. 3 is a side perspective view of ball roller assemblies of the printer of FIG. 1 shown interacting with a paper-supporting platen.

In a preferred embodiment of the printer 10, the printhead 12 does not span the entire width of the print medium, such as a sheet of paper 24. Consequently, a means for moving the paper in the widthwise direction of the paper 24 is required, in addition to a means for moving the paper in the lengthwise direction. Referring to FIGS. 1, 2, and 3, ball roller assembly 14 is provided to move a paper-supporting platen 16 back and forth along the width (y-axis) and the length (x-axis) of the paper. Ball roller assemblies are preferred over conventional printer rollers because the ball rollers can move the paper along both the x and the y axes, whereas a conventional printer roller only moves the paper along a single axis. The paper-supporting platen preferably includes means for securing the paper 24 in a fixed position. A vacuum system (not shown) on the paper-supporting surface of the platen 16 can be utilized to securely fix the position of the paper 24 on the platen.

The ball roller assembly 14 preferably has multiple ball rollers 11, 13, and 15 to move the paper along both the x-axis and the y-axis. As is well known in the art, an important consideration in placement of rollers is to avoid contact with the surface regions of paper 24 which have a high likelihood of supporting freshly deposited ink. By utilizing the ball roller assembly and the paper-supporting platen 16, the printed surface of paper 24 is not contacted by any rollers during a print job. Consequently, it is possible to employ multiple heads on the printer 10 without concern for smearing caused by contact with rollers.

Figure 4:
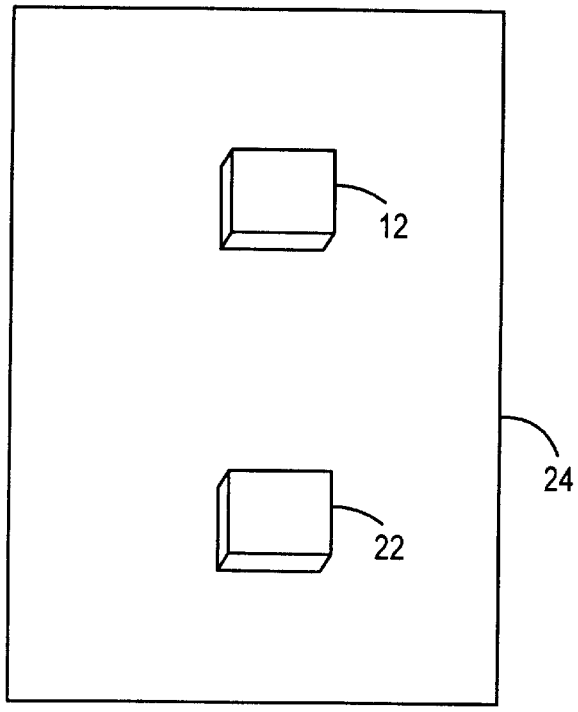
FIG. 4 is an overhead perspective view of two inkjet printheads of a dual-printhead embodiment the printer in FIG. 1.
Figure 5:
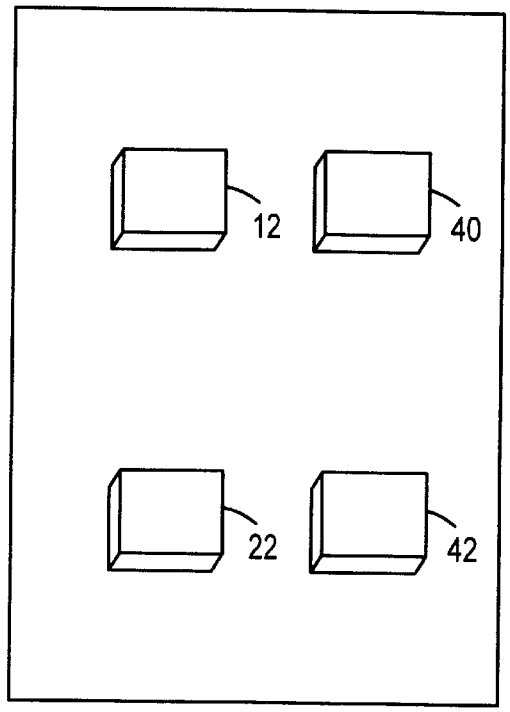
FIG. 5 is an overhead perspective view of four inkjet printheads in a four-printhead embodiment of the invention.

With reference to FIG. 4, one embodiment of the inkjet printer 10 includes first inkjet printhead 12 and second inkjet printhead 22. The addition of the second printhead 22 decreases the print time for print jobs by approximately one-half, because the total print region surface area is doubled. The printheads are shown in FIG. 4 without ink supplies for purposes of clear illustration. However, it should be noted that the first printhead 12 and the second printhead 22 can each be equipped with its own ink supply. Alternatively, both printheads can be connected to a single ink supply. The fact that the printheads are not required to scan the width of paper 24 simplifies the task of connecting both printheads to a single ink supply. Referring to FIG. 5, another embodiment of the printer employs four printheads 12, 22, 40, and 42. By increasing the number of printheads, the print time for a print job is proportionately decreased.

Figure 6:
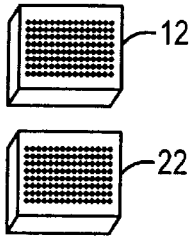
FIG. 6 is a perspective view of the inkjet nozzles on the inkjet printheads shown in FIG. 5.
Figure 7:
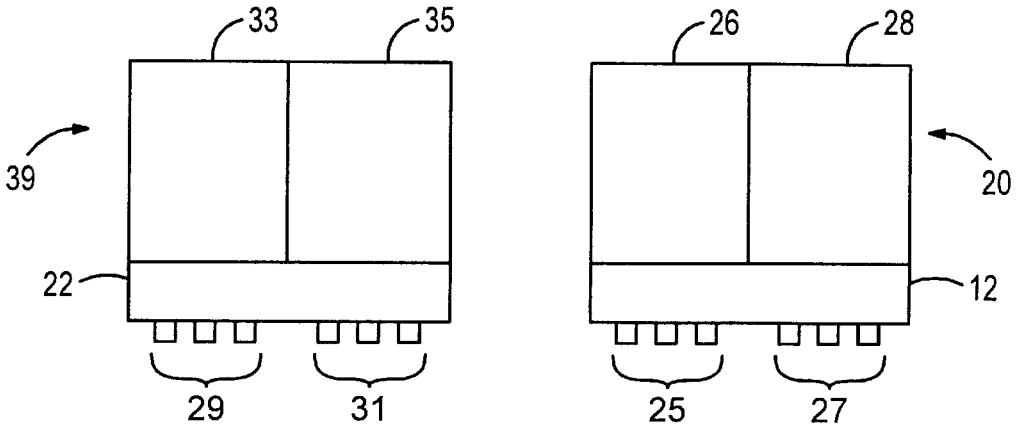
FIG. 7 is a side perspective view of the inkjet printheads shown in FIG. 5.

Referring to FIGS. 6 and 7, in one embodiment, the first ink supply 20 is a dual-source ink supply which includes a first print-mode ink supply 26 and a second print-mode ink supply 28. A second ink supply 39 for the second printhead 22 also includes a first print-mode ink supply 33 and a second print-mode ink supply 35. Alternatively, both printheads 12 and 22 can share a single first print-mode ink supply and a single second print-mode ink supply. The first print-mode ink supplies 26 and 33 might contain general purpose color printing ink, while the second print-mode ink supplies 28 and 35 contain photographic color printing ink. The general purpose color printing ink supplies and the photographic color printing ink supplies of both the first and second printheads 12 and 22 each have four ink reservoirs (not shown) which provide three primary colors required for color printing and black ink. Each reservoir is in fluid communication with selected inkjet nozzles. Alternatively, the dual-supply ink reservoirs might contain any other combination of ink types for specialized printing.

The first inkjet printhead 12 includes a first array of inkjet nozzles 25 in fluid communication with the general purpose color printing ink supply 26, and a second array of inkjet nozzles 27 in fluid communication with the photographic color printing ink supply 28. The second inkjet printhead 22 includes a third array of inkjet nozzles 29 in fluid communication with general purpose color printing ink supply 33 and a fourth array of inkjet nozzles 31 in fluid communication with photographic color printing ink supply 35. As will be discussed in greater detail below, the inkjet printer 10 is capable of performing an automatic mode switch, wherein the first and third arrays of inkjet nozzles 25 and 29 are enabled and the second and fourth arrays of inkjet nozzles 27 and 31 are disabled (or vice versa) in response to a user-generated mode switch request. The printer 10 is also capable of simultaneously operating in multiple print-modes such that all four inkjet nozzle arrays are simultaneously activated.

Figure 8:
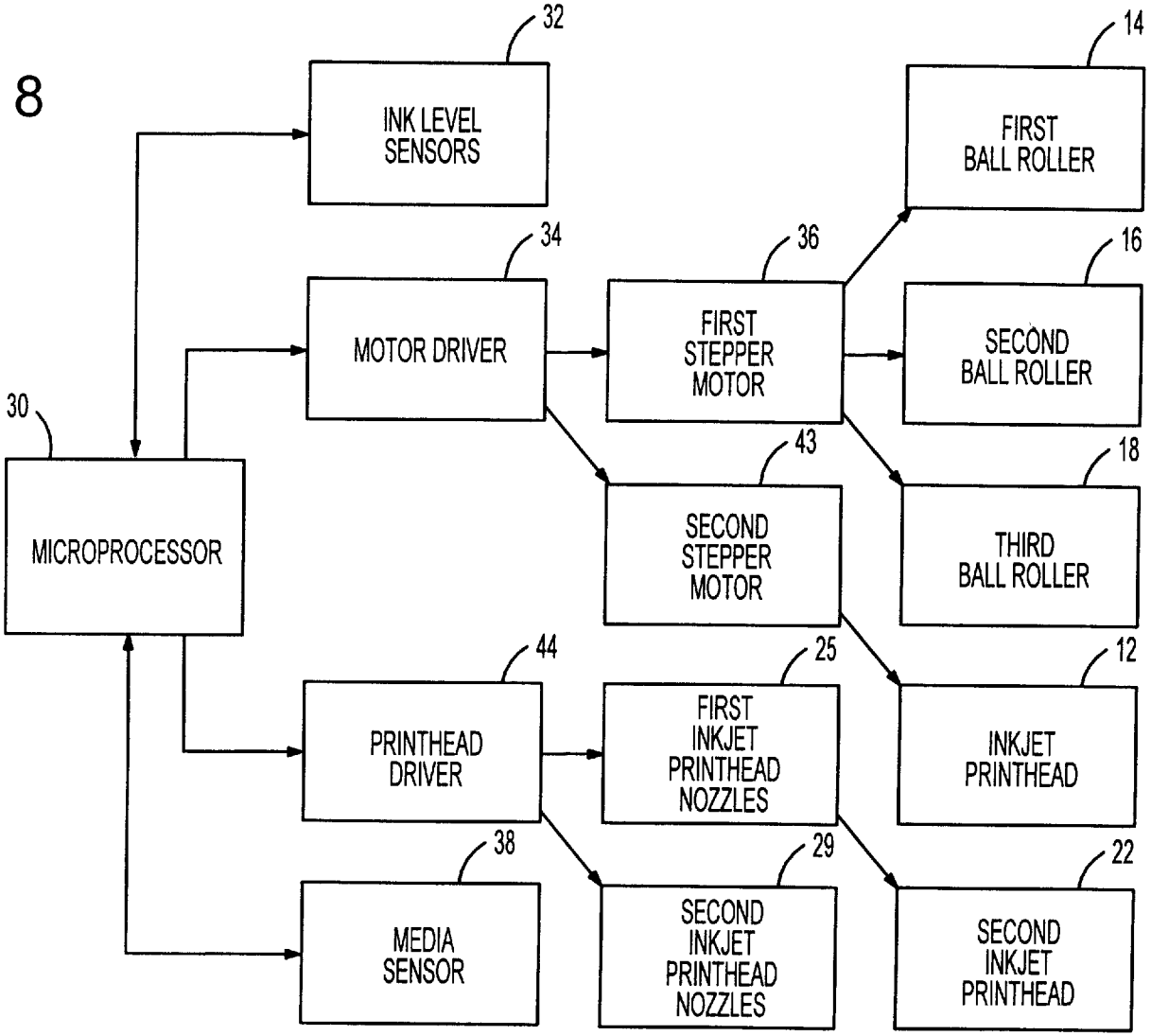
FIG. 8 is a schematic diagram of the components of the inkjet printer shown in FIG. 1.

Referring to FIG. 8, a microprocessor 30 in printer 10 provides a means for coordinating operations of the numerous components required for performing print jobs. A motor driver 34 transmits command signals to a first stepper motor 36. The first stepper motor 36 is capable of actuating precise increments of rotation in the ball rollers of ball roller assembly 14 along either the x-axis or the y-axis, or a combination of the x and y directions. A printhead driver 44 transmits firing commands to selected ones of the inkjet nozzles of the first inkjet printhead 12 or the first and second inkjet printheads 12 and 22. In one embodiment, a second stepper motor 43 is employed to move inkjet printheads 12 and 22 either along the x-axis or the y-axis in small increments. Each increment of motion by the printhead(s) 12 and/or 22 is no more than the approximate distance between two adjacent inkjet nozzles of a print region for a single inkjet nozzle. By coordinating the firing of selected inkjet nozzles with the incremental movement of the inkjet printhead(s), an increased printing resolution is possible. Alternatively, increased printing resolution can be achieved through coordination of incremental movement of the paper-supporting platen 16 by ball roller assembly 14 with the firing of selected inkjet nozzles. The second stepper motor 43 can be activated for print jobs which require high resolution printing. When the high resolution portion of a print job is completed, the processor 30 deactivates the second stepper motor 43 and printing resumes in the lower resolution mode. When the microprocessor 30 receives a print job request from an attached personal computer (not shown), the microprocessor distributes commands to the various device drivers to execute functions required to perform the print job.

In the dual-printhead embodiment, the microprocessor 30 coordinates cooperation between the first 12 and second 22 printheads by assigning a first portion of the print job to the first printhead 12 and a second portion of the print job to the second printhead 22. Referring to FIGS. 4 and 8, for a particular page in a print job, the microprocessor 30 assigns the first printhead 12 to print a portion of the desired print pattern for the top half of the page, while the second printhead 22 is assigned to simultaneously print a portion of the desired print pattern for the bottom half of the page. The microprocessor 30 instructs the printhead driver 44 to transmit firing signals to the inkjet nozzles of the first and second printheads 12 and 22 according to the print job assignments for the first and second printheads. The microprocessor 30 executes a stitching algorithm to minimize the visibility of the boundaries of the first and second portions of each print job. Alternatively, the stitching algorithm is executed by a processor in the attached PC. In one implementation, the algorithm takes into account contrast patterns of coloring or shading of print jobs in determining the boundaries of the first and second portions of each print job. The boundaries of the first and second portions can also overlap slightly in order to minimize the visibility of the boundaries. A media sensor 38 provides the microprocessor with paper position data which the microprocessor 30 utilizes to make adjustments for errors committed in positioning the paper.

In the dual-source ink supply embodiment, the microprocessor 30 responds to a print-mode switch request by directing the printhead driver 44 to instruct printheads 12 and 22 to each disable one array of nozzles and to enable the other array. For example, if the printer 10 is operating in a photographic color print-mode, the microprocessor 30 responds to a print-mode switch request by enabling the second and fourth nozzle arrays 27 and 31 and disabling the first and third nozzle arrays 25 and 29. Alternatively, if the printer 10 is equipped with only one printhead, the microprocessor 30 directs the printhead driver 44 to transmit print-mode switch instructions to the first printhead 12. Ink level sensors 32 provide the microprocessor 30 with data regarding ink levels, so that the microprocessor can take steps necessary to perform user notification when ink levels fall below a threshold level. The user notification can occur at the time a user requests a print job. For example, when the user requests a print job, the microprocessor 30 can respond by determining whether sufficient ink remains to complete the print job. If insufficient ink remains, the microprocessor 30 alerts the PC of the insufficiency.

The microprocessor 30 can simultaneously activate both print-modes as required by a particular print job. For example, a print job might include a photograph requiring photographic color ink which is surrounded by a border requiring general purpose color ink. During simultaneous activation of both print-modes, selected first 25 and third 29 array nozzles perform general purpose color ink printing of the border region while selected second 27 and fourth 31 nozzles perform photographic color ink printing of the photograph region.

Figure 9:
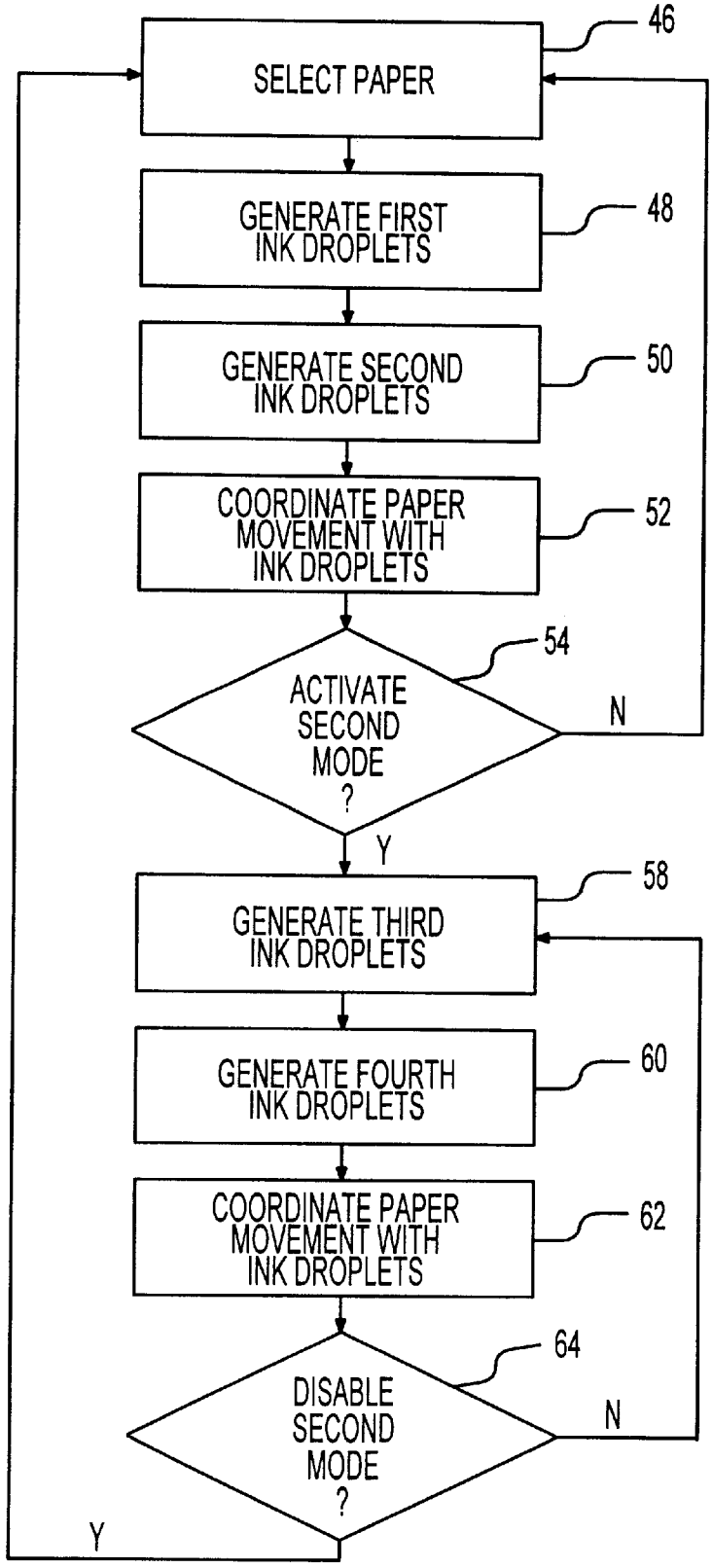
FIG. 9 is a flow diagram of a printing method utilizing the inkjet printer shown in FIG. 8.

Referring to FIG. 9, a method of printing utilizing the inkjet printer 10 of the present invention includes a step 46 of selecting a sheet of paper and positioning the paper to execute a print job. According to instructions from the microprocessor 30, the printhead driver 44 transmits firing signals to selected first array nozzles of the first printhead, resulting in a first set of ink droplets being directed toward the paper surface in step 48. In step 52, the microprocessor coordinates operation of the stepper motor 36 to move the paper in concert with the firing of the first array nozzles 25. If the printer 10 includes a second printhead 22, the microprocessor 30 coordinates the firing of first array nozzles 25 on the first printhead 12 with firing of third array nozzles 29 on the second printhead 22 in step 50, such that the first array nozzles print a first portion of the print job on a first section of the paper simultaneously with the third array nozzles printing a second portion of the print job on a second section of the paper.

In decision step 54, the microprocessor 30 determines whether a request has been received to enable the second print-mode. If no second print-mode request is received, the printer returns to step 46 and selects another sheet of paper to continue printing in the general purpose color print-mode. Upon receiving the request to enable the second mode, the printhead driver 44 enables the second array of inkjet nozzles 27 on the first printhead which is in fluid communication with the first photographic color printing ink supply 28. If the printer 10 employs a second printhead 22, the printhead driver 44 enables the fourth array nozzles 31 associated with the second photographic color printing ink supply 35. In steps 58 and 60, the printhead driver 44 transmits firing signals to selected second and fourth array nozzles on the first and second printheads in response to microprocessor signals. In step 62, the microprocessor 30 coordinates operation of the ball roller assembly 14 with the firing of selected nozzles of the first 25, second 27, third 29, and fourth 31 arrays of printhead nozzles to print a predetermined printing pattern.

In decision step 64, the microprocessor 30 determines whether a request to disable the second print-mode has been received. If no request has been received, the printing process is repeated starting at step 56. The general purpose color printing process is performed starting at step 46 if the microprocessor 30 determines that a request to disable the second print-mode request has been received. Furthermore, microprocessor 30 is capable of switching between first and second print-modes in addition to simultaneously enabling the print-modes. It will be appreciated by persons of ordinary skill in the art that the above-described method can be practiced both in the single printhead and double printhead embodiments of the printer 10. Also, the invention can easily be extended to n printheads simultaneously printing in n zones on the same page of a paper where n is greater than 2. It should also be noted that the number of arrays of inkjet nozzles and the number of different color ink supplies can be a greater number than the examples discussed. Furthermore, the number of array nozzles with a different number of ink colors can be optimized for a particular application in printing.

What is claimed is:

1. An inkjet printer comprising:

a first inkjet printhead having a first array of inkjet nozzles and a first supply of ink in fluid communication with said first array of nozzles such that each nozzle projects first ink droplets toward a first fixed region during a first printhead operational mode;

first mechanical means for moving a print medium relative to said first fixed region and along two perpendicular axes of motion, movement of said print medium along each said axis of motion varying alignment of said first fixed region with areas of said print medium; and means for coordinating said firing of said first array of inkjet nozzles with operation of said first mechanical means to print a first desired pattern on said print medium.

2. The inkjet printer of claim 1 wherein said first printhead includes a second array of nozzles in fluid communication with said first ink supply such that each nozzle in said second array projects second ink droplets in a direction approximately parallel to said first ink droplets, projections of said second ink droplets being toward a second fixed region, said first ink supply including a first ink reservoir for a first mode of printing and a second ink reservoir for a second mode of printing, at least a portion of said first array of nozzles being in fluid communication with said first ink reservoir during said first print-mode and at least a portion of said second array of nozzles being in fluid communication with said second ink reservoir during said second mode printing.

3. The inkjet printer of claim 2 further comprising a print-mode controller configured to activate said first array of nozzles during said first mode of printing and to activate said second array of nozzles during said second mode of printing.

4. The inkjet printer of claim 2 further comprising a second inkjet printhead having third and fourth arrays of nozzles, at least a portion of said third array of nozzles being in fluid communication with a third ink reservoir on said second printhead and at least a portion of said fourth array of nozzles being in fluid communication with a fourth ink reservoir on said second printhead, said coordinating means being configured to assign at least one of said first and said second arrays of nozzles to a first section of said print medium and to assign at least one of said third and fourth nozzle arrays to a second section of said print medium, such that said at least one of said first and said second nozzle arrays prints a first portion of a second desired pattern in said first section simultaneously with said at least one of said third and said fourth nozzle arrays printing a second portion of said second desired pattern in said second section.

5. The inkjet printer of claim 4 wherein said coordinating means is configured to assign both said first and said second arrays of nozzles to said first section of said print medium and to assign both said third and said fourth arrays of nozzles to said second section of said print medium, such that said first and second nozzle arrays print said first portion simultaneously with said third and said fourth nozzles arrays printing said second portion.

6. The inkjet printer of claim 1 further comprising a second printhead having a third array of inkjet nozzles, said coordinating means being configured to assign said first array of nozzles to a first section of said print medium and to assign a second section of said print medium to said third array of nozzles, such that said first array of nozzles prints a first portion of said first desired pattern in said first section of said print medium simultaneously with said third array of nozzles printing a second portion of said first desired pattern in said second section of said print medium.

7. The inkjet printer of claim 1 further comprising an ink level sensor for said first ink supply.

8. The inkjet printer of claim 1 further comprising second mechanical means for moving said inkjet printhead a first distance along one of said two perpendicular axes of motion during a second printhead operational mode, said first distance being no more than an approximate distance between two of said first fixed regions, said coordinating means being configured to coordinate said firing of said first array of inkjet nozzles with operation of said second mechanical means to print a third desired high resolution pattern during said second printhead operational mode.

9. The inkjet printer of claim 1 wherein said first mechanical means is configured to move said print medium a first distance along at least one of said two perpendicular axes of motion relative to said first fixed region, said first distance being no more than a width of said first fixed region, said coordinating means being configured to coordinate said firing of said first array of inkjet nozzles during said movement of said print medium said first distance along said one of said two perpendicular axes to produce a third high resolution pattern.

10. A method of printing utilizing an inkjet printer comprising the steps of:

providing a printing surface;

projecting a first plurality of ink droplets from a first inkjet printhead toward said printing surface such that each of said first ink droplets is projected in a direction that is approximately perpendicular with said printing surface;

moving said printing surface along two perpendicular axes of motion such that at least one of said two axes is perpendicular to said direction of said ink droplets; and coordinating said movement of said printing surface with said projecting of said first plurality of ink droplets from said first inkjet printhead to print a first predetermined pattern on said printing surface.

11. The method of claim 10 further comprising the step of projecting a second plurality of ink droplets from a second inkjet printhead toward said printing surface in a direction that is approximately parallel to said direction of said first plurality of droplets, said projecting of said first plurality of ink droplets occurring within a first area of said printing surface and said projecting of said second plurality of ink droplets occurring within a second area of said printing surface such that said projecting of said first plurality and said second plurality of ink droplets is coordinated with said moving of said printing surface to print said first predetermined pattern.

12. The method of claim 11 wherein said steps of projecting said first plurality and said second plurality of ink droplets include projecting at least some of said first and said second pluralities of ink droplets from a first print-mode ink reservoir, the method further comprising the step of enabling a second print-mode, including the steps of:

projecting at least a portion of a third plurality of ink droplets from said first inkjet printhead utilizing a second print-mode ink reservoir and projecting at least a portion of a fourth plurality of ink droplets from said second inkjet printhead utilizing said second print-mode ink reservoir in the absence of removing said first print-mode ink reservoir and replacing said first print-mode ink reservoir with said second print-mode ink reservoir; and moving said printing surface along said two axes in coordination with said projecting of said third and said fourth pluralities of ink droplets to print a second predetermined pattern.

13. The method of claim 12 wherein said steps of projecting said first and said second pluralities of ink droplets include projecting said first and said second pluralities of ink droplets from a plurality of general purpose color printing ink reservoirs and said steps of projecting said third and fourth pluralities of ink droplets include projecting said third and said fourth pluralities of ink droplets from a plurality of photographic color ink reservoirs.

14. The method of claim 10 wherein said step of projecting said first plurality of ink droplets includes projecting at least a portion of said first plurality of ink droplets from a first print-mode ink reservoir, the method further comprising the step of enabling a second print-mode, including the steps of:

projecting at least a portion of a second plurality of ink droplets from a second print-mode ink reservoir in the absence of removing said first print-mode ink reservoir and replacing said first print-mode ink reservoir with said second print-mode ink reservoir; and moving said printing surface along said two axes in coordination with said projecting of said second plurality of ink droplets to print a second predetermined pattern on said printing surface.

15. An inkjet printer comprising:

a stationary base;

a platen having a first surface for contacting and securely supporting a print medium and a second surface opposite said first surface;

a first ball roller assembly connected to said stationary base and having a ball roller with a surface for frictional contact with said second surface of said platen to drive said platen and said securely supported print medium along a first axis of motion and a second axis of motion perpendicular to said first axis of motion;

a first inkjet printhead connected to said stationary base and having a first array of nozzles in fluid communication with a first ink supply to project a first plurality of ink droplets in a direction substantially perpendicular to a surface of said print medium;

motor means for rotating said ball roller about first and said second axes of rotation; and controller means for coordinating operation of said motor means in concert with selective activation of particular ones of said first array of nozzles to generate a predetermined pattern on said print medium.

16. The inkjet printer of claim 15 further comprising a second inkjet printhead connected to said stationary base and having a second array of nozzles positioned approximately coplanar to said first array of nozzles of said first printhead, said controller means being configured to coordinate operation of said motor means with firing of selected nozzles of said first and said second arrays of nozzles such that said first array generates a first portion of said predetermined pattern and said second array generates a second portion of said predetermined pattern.

17. The inkjet printer of claim 15 wherein said first inkjet printhead includes a third array of nozzles and said ink supply includes a first print-mode ink supply in fluid communication with said first array of nozzles and a second print-mode ink supply in fluid communication with said third array of nozzles, said controller means having first and second operating modes wherein said controller means is configured to activate said first array of nozzles during said first operating mode and to activate said third array of nozzles during said second operating mode.

18. The inkjet printer of claim 17 wherein said controller means is configured to simultaneously activate said first and said second operating modes in response to a particular print job request.

19. The inkjet printer of claim 15 further comprising a second inkjet printhead connected to said stationary base and having second and fourth arrays of nozzles, said first printhead including a third array of nozzles, said ink supply including a first print-mode ink supply in fluid communication with said first and said second arrays of nozzles and a second print-mode ink supply in fluid communication with said third and said fourth arrays of nozzles, said controller means having first and second operating modes wherein said controller means is configured to activate said first and said second arrays of nozzles during said first operating mode and to activate said third and said fourth arrays of nozzles during said second operating mode.

20. The inkjet printer of claim 15 wherein said first inkjet printhead is one of a set of n printheads connected to said stationary base, n being a whole integer greater than 2.

* * * * *